US008037840B2

(12) United States Patent
Sutter

(10) Patent No.: US 8,037,840 B2
(45) Date of Patent: Oct. 18, 2011

(54) LAMELLAR GROUND MARKING

(75) Inventor: Wolfgang Sutter, Halstenbek (DE)

(73) Assignee: Lufthansa Technik AG, Hamburg (DE)

( * ) Notice: Subject to any disclaimer, the term of this patent is extended or adjusted under 35 U.S.C. 154(b) by 463 days.

(21) Appl. No.: 12/085,975

(22) PCT Filed: Apr. 10, 2007

(86) PCT No.: PCT/EP2007/003182
§ 371 (c)(1),
(2), (4) Date: Jun. 2, 2008

(87) PCT Pub. No.: WO2007/118641
PCT Pub. Date: Oct. 25, 2007

(65) Prior Publication Data

US 2009/0229510 A1 Sep. 17, 2009

(30) Foreign Application Priority Data

Apr. 12, 2006 (EP) ..... 06007755

(51) Int. Cl.
*G08B 6/00* (2006.01)

(52) U.S. Cl. ..... 116/200; 116/205; D10/111

(58) Field of Classification Search ..... 116/200–201, 116/205, 209, DIG. 17; 434/112–114; D10/111, D10/114, 114.1; D19/5
See application file for complete search history.

(56) References Cited

U.S. PATENT DOCUMENTS 2,430,534 A * 11/1947 Rodli ..... 264/112
2,802,443 A * 8/1957 Hanson ..... 116/63 P
2,993,465 A * 7/1961 Ginsley et al. ..... 116/63 P
3,322,093 A * 5/1967 Goland et al. ..... 116/63 R
3,408,025 A * 10/1968 Davis ..... 244/118.5
4,021,948 A * 5/1977 Mosch ..... 40/591
4,179,160 A * 12/1979 Sabo ..... 116/205
4,401,050 A * 8/1983 Britt et al. ..... 116/205
4,794,373 A * 12/1988 Harrison ..... 340/286.01
4,801,928 A * 1/1989 Minter ..... 340/691.2
(Continued)

FOREIGN PATENT DOCUMENTS

GB 2 110 864 A 6/1983
(Continued)

OTHER PUBLICATIONS

Patent Abstracts of Japan vol. 2003, No. 12, Dec. 5, 2003 & JP2004 163621 A, Jun. 10, 2004.

*Primary Examiner* — R. A. Smith
*Assistant Examiner* — Tania Courson
(74) *Attorney, Agent, or Firm* — Alix, Yale & Ristas, LLP

(57) ABSTRACT

The lamellar or strip-shaped floor marking, in particular for means of transportation, in particular airplanes, having a photoluminescent layer on which covering elements which appear dark in comparison with the luminous layer and which serve as a directional indication are arranged in such a way that acute-angled markings pointing in a direction are formed. The covering elements extend over the entire width of the floor marking and taper on both sides at one of their ends so that a recess bounded by an acute-angled isosceles triangle is formed there. The covering elements are substantially adjacent to one another, at least in groups, in such a way that the distance between them is smaller than approximately three times their longitudinal extent.

20 Claims, 2 Drawing Sheets

U.S. PATENT DOCUMENTS

| | | | | | |
|---|---|---|---|---|---|
| D305,779 | S | * | 1/1990 | Schriever | D20/40 |
| 5,000,111 | A | | 3/1991 | Gibson | |
| 5,027,741 | A | * | 7/1991 | Smith et al. | 116/205 |
| 5,101,756 | A | * | 4/1992 | Strumbos | 116/234 |
| 5,331,918 | A | * | 7/1994 | Honigsbaum | 116/205 |
| D356,659 | S | * | 3/1995 | Glass | D29/101.5 |
| D373,432 | S | * | 9/1996 | Wu | D26/28 |
| D383,081 | S | * | 9/1997 | Ffrench | D10/111 |
| D388,725 | S | * | 1/1998 | Estrada | D10/111 |
| 5,714,255 | A | * | 2/1998 | Yeh | 428/364 |
| 5,917,326 | A | * | 6/1999 | Gonzalez et al. | 324/326 |
| 6,025,773 | A | * | 2/2000 | Bresnan | 340/407.1 |
| 6,237,266 | B1 | * | 5/2001 | Tassey et al. | 40/542 |
| 6,472,994 | B1 | * | 10/2002 | Tator | 340/815.4 |
| 6,499,421 | B1 | * | 12/2002 | Honigsbaum | 116/205 |
| 6,739,980 | B2 | * | 5/2004 | Scott et al. | 473/200 |
| 6,854,163 | B1 | * | 2/2005 | Ruana | 16/431 |
| 7,404,372 | B2 | * | 7/2008 | Aasgaard | 116/28 R |
| D588,036 | S | * | 3/2009 | Rees | D10/109 |
| 2002/0015309 | A1 | | 2/2002 | Stokes et al. | |
| 2003/0021933 | A1 | * | 1/2003 | Milliorn et al. | 428/40.1 |
| 2003/0029372 | A1 | * | 2/2003 | Moore | 116/205 |
| 2008/0092796 | A1 | * | 4/2008 | Laivins et al. | 116/173 |
| 2008/0282961 | A1 | * | 11/2008 | Halberg et al. | 116/205 |
| 2009/0217862 | A1 | * | 9/2009 | Christensen | 116/205 |

FOREIGN PATENT DOCUMENTS

| | | |
|---|---|---|
| WO | WO 87/02813 A | 5/1987 |

* cited by examiner

LAMELLAR GROUND MARKING

BACKGROUND

The invention relates to a lamellar or strip-shaped floor marking, in particular for means of transportation, very particularly for airplanes, having a photoluminescent layer on which covering elements which appear dark in comparison with the luminous layer and which serve as a directional indication are arranged in such a way that acute-angled markings pointing in a direction are formed.

It is known to affix lamellar or strip-shaped floor markings having a photoluminescent layer in airplanes. By means of daylight or the illumination in the airplane cabin, the photoluminescent layer is made to glow. This glow continues for a long period of time when the floor marking is no longer being illuminated. In the case of an accident, airplane passengers can orient themselves even in darkness by means of these glowing floor markings. An external illumination, which is complex and fault-prone, is not required.

These floor markings indicate escape routes. In this case there are also no particular problems if the airplane, as is conventional, is provided with emergency exits at the front and rear end of the airplane cabin (and usually also over the wings). In that case, it is not necessarily a matter of finding the nearest emergency exit in the case of an accident but rather, led by the glowing floor markings, of following the other passengers to the nearest exit. However, it is a different proposition if the airplane has a so-called "dead end", that is to say if, for example, no emergency exit is provided at the rear end. There is then the danger that in the case of an accident passengers follow the floor markings in the wrong direction, namely to the end of a cabin not provided with an emergency exit. In order to avoid this, it is known to affix opaque markings in triangular form on the floor markings, the tip of the triangle pointing in the direction of the escape route. Such dark markings can be created by applying a coating, for example. The applied coating on the one hand prevents the photoluminescent layer underneath from being "charged" by incident light. On the other hand, light that is nevertheless emitted therefrom is absorbed by the markings. These markings usually have a distance between them of approximately 50 cm. A closer distance is clearly considered not to be expedient, because in this case there is no longer enough glowing surface of the floor marking available.

A problem now occurs if a passenger wishes to observe the marking in order to see in which direction the tip of the triangle is pointing. Due to the darkness, the cone cells of the retina of the eye, which impart color vision and only have a low light sensitivity, do not impart a sense of sight. This is only the case for the rod cells, which are active in the process of seeing light and dark and have a high light sensitivity. However, in the middle of the retina, the fovea, there are no or only very few rod cells which react to low brightness. Thus, if an attempt is made to look at the marking, so that the marking is imaged on the fovea, it is difficult to recognize the marking or it is not seen at all, since the brightness is not sufficient to excite the cone cells arranged in the fovea. This is particularly the case if the fluorescent layer is additionally covered by a film of paint, so that the floor marking no longer glows as brightly. Furthermore, problems occur particularly if the floor markings have been in the dark for an extended period of time, that is to say in the case of night flights or after the first time operation is commenced in the morning. The problems are further exacerbated if the floor markings only have a small width. In this case, the triangles would have to take up the entire width of the floor marking, so that likewise the recognition of them is worse.

However, the abovementioned problems do not only occur in the airplanes mentioned for the explanation, although this case is particularly important. Similar problems can also occur in different means of transportation or dark rooms, for example cinemas.

SUMMARY

A floor marking of the type mentioned initially which allows a better detection of the direction of escape even in low adverse circumstances.

The covering elements extend over the entire width of the floor marking and taper on both sides at one of their ends so that a recess bounded by an acute-angled isosceles triangle is formed there, and the covering elements are substantially adjacent to one another, at least in groups, in such a way that the distance between them is smaller than approximately three times their longitudinal extent.

The covering elements extend over the entire width of the floor marking. Even in the case of narrower floor markings, the direction-indicating elements are then not that small that recognizing them presents any difficulties. Furthermore, dark triangles, the tips of which show the direction of escape, are not used. Rather, covering elements which taper on both sides at one of their ends so that a recess bounded by an acute-angled isosceles triangle is formed there are used. The tip of the triangle, which is intended to show the direction of escape, is thus, in contrast with the prior art, not dark but bright. This alone eases recognition of the direction of escape. However, in addition to this, the covers are substantially adjacent to one another, at least in groups, in such a way that the distance between them is smaller than approximately three times their longitudinal extent. Thus, if an attempt is made to precisely observe or locate a floor marking, then it is possible that no visible image is obtained in the fovea. However, immediately next to the marking which is being observed there one are other markings, which are imaged outside the fovea and can be seen there due to the very high light sensitivity of the rod cells arranged outside the fovea. Experiments have shown that the field of view which is insensitive from an observation height of 1.20 m (if the person is moving through the airplane in a stooped position due to the development of smoke) approximately has an a diameter of 200 mm. Directly outside this region, further markings will then be recognizable, so that the direction of the escape route can be recognized.

The covering elements can be produced by painting or adhesively bonding corresponding elements as is the case in the prior art.

Advantageously, the distance between the covering elements is smaller than or approximately equal to their longitudinal extent. Thus, one on the one hand, a plurality of direction-indicating triangles is always visible. In another advantageous embodiment this distance is greater, so that more glowing regions are exposed.

The covering elements are at least arranged in groups, wherein the distance between the groups, in which the floor marking is glowing evenly, should not be too big. However, in another advantageous embodiment such intermediate distances are avoided by all covers having the same separation.

At that end at which the covers are not provided with the acute-angled recess, they can be bounded by a straight line, to be precise transverse to the longitudinal direction of the floor marking. This could however mean that there is a certain psychological inhibition threshold, since not only triangles or arrows pointing in the direction of escape are provided, but also transversely running markings. This can be avoided if the covers converge at an acute angle at their other end, that is to say at that end at which they are not provided with the acute-angled recess. In this case, the angles at both ends advantageously have the same size.

The covers can then be arranged at such a distance from each other that the arrangement is chosen in such a way that the covers have the same shape, at least within groups, as the uncovered regions of the floor markings. In this manner successive bright and dark arrows which all point in the same direction are obtained.

Advantageously, the covering elements have a length which is 2 to 20 times the width of the floor marking. In this case, the isosceles recesses and protrusions expediently have a length which corresponds to half to a quarter of the length of the cover.

All these measures on the one hand ensure that, taking the physical and biological conditions of the visual process into account, markings which indicate the direction of escape can be seen in an optimum manner. This does not depend on a thought process; the passenger is automatically led in the direction of the exit, the markings being designed in such a way that they can be seen in an improved manner with aid of the physical and biological visual process.

Advantageously, the floor marking is covered by a non-slip and abrasion-resistant layer. In this case, the film is advantageously colored in order to give the floor marking the color which is particularly suited for its purpose.

If a reflective layer is arranged under the luminous layer, then light emitted downward by the luminous layer is also at least partially reflected upward and contributes to the brightness.

The floor marking can be attached particularly easily if it is designed to be self-adhesive or provided with a double-sided adhesive tape on its underside.

When airplanes are mentioned in the description above, then this is a preferred area of application. However, the floor marking can also be used for different purposes, for example for cinemas, theaters or other means of transportation.

BRIEF DESCRIPTION OF THE DRAWINGS

Advantageous embodiments are described in an exemplary manner below with reference to the attached drawings, in which.

DETAILED DESCRIPTION

Figure 1:
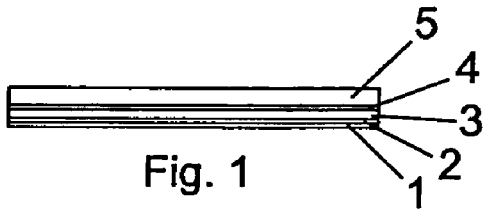
FIG. 1 shows the floor marking in a cross section.

As is shown in FIG. 1, the floor marking has an adhesive layer 1, by means of which it can be fixed to the floor. A reflective layer 2, which directs light scattered downward by the luminous layer 3 upward, is located above this layer. The covering elements are arranged in a layer 4. The floor marking is covered by means of a non-slip, possibly also colored polycarbonate layer 5.

Figure 2:
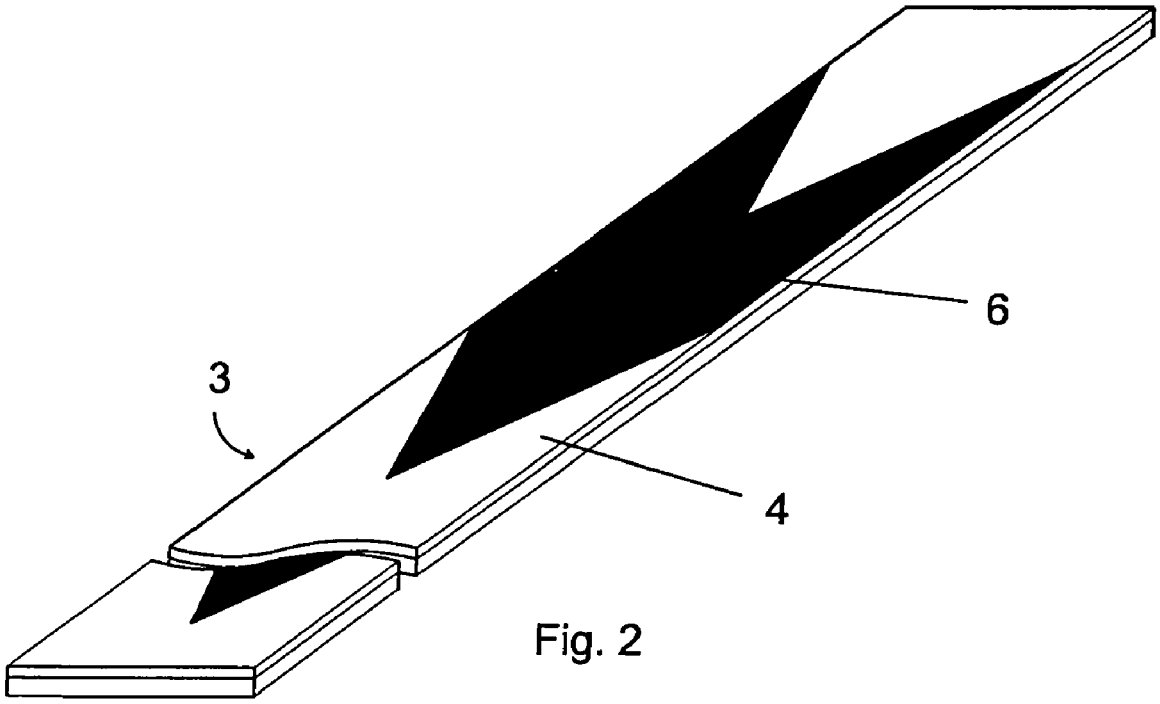
FIG. 2 shows the floor marking in a perspective view with a middle part omitted.

As can be seen from FIG. 2, the covering elements 6 of the layer 4 merge to a point toward the front and have a corresponding triangular recess toward the back.

Figure 3:
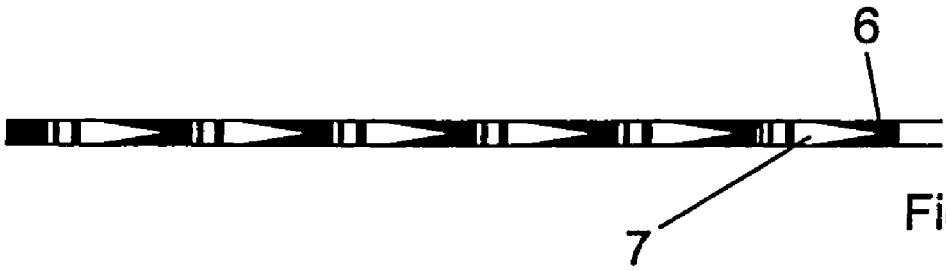
FIGS. 3 to 7 show different embodiments of the markings by choosing different covering elements.
Figure 4:
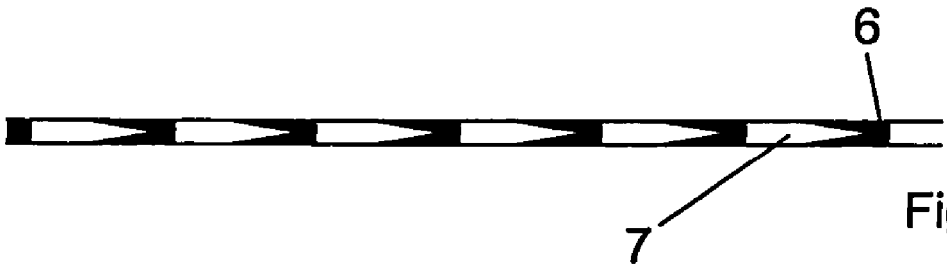

In the embodiments of FIGS. 3 and 4 the covering elements 6, indeed likewise have a rear triangular recess by means of which glowing arrows of the uncovered regions 7 of the floor marking are created. At their front end, the covers 6 are bounded by a straight line, so that a picture of an arrow is obtained.

Figure 5:
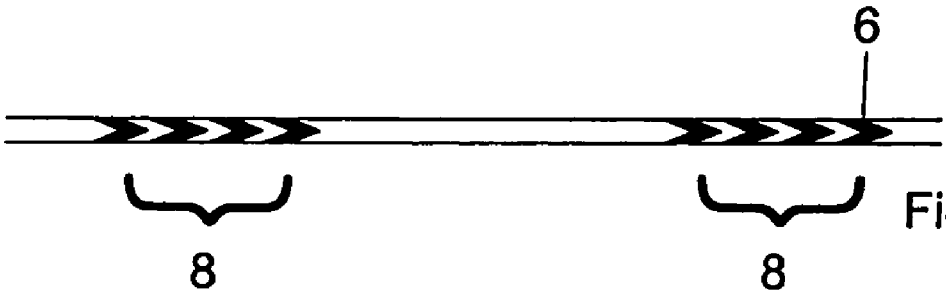
Figure 6:
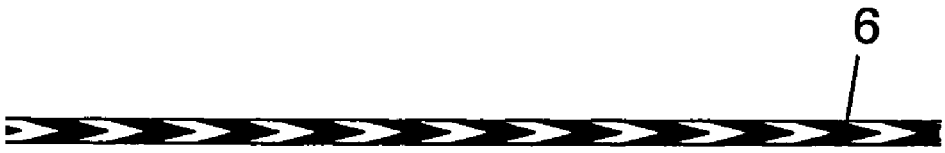
Figure 7:
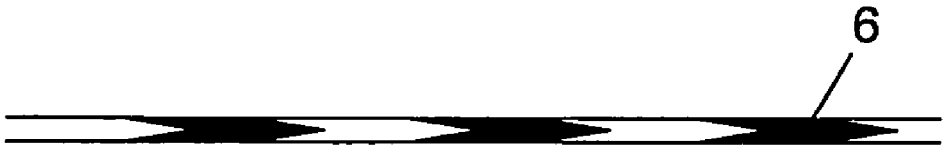

In the case of the embodiment of FIGS. 5, 6 and 7 the covers 6 have an acute-angled boundary at both ends. In this case, they are arranged such that alternately a bright roof-shaped element and a dark, similarly roof-shaped element are created. In the embodiment of FIG. 5 a plurality of covers 6 are respectively gathered together in groups 8, whereas in the embodiment of FIGS. 6 and 7 the pattern is uniform over the entire length of the floor marking. In the embodiment of FIG. 6, the covers have a length which is approximately twice the width, whereas the covers 6 of the embodiment of FIG. 7 are significantly longer.

A floor marking which provides reliable indications of the direction of escape even in the case of floor markings having a narrow width is thus created by the invention. According to the invention, it is possible to design the floor markings not with a width of 30 mm, which has been conventional until now, but with a smaller width of, for example, 17 mm.

The invention claimed is:

1. A continuous lamellar or strip-shaped floor marking having a luminous layer on which covering elements which appear dark in comparison with the luminous layer and which serve as a directional indication are arranged in such a way that markings pointing in a direction are formed, wherein the covering elements extend over the entire width of the floor marking and taper on both sides at one of their ends so that a recess bounded by an isosceles triangle is formed there and the covering elements are substantially adjacent to one another, at least in groups, in such a way that the distance between them is smaller than approximately three times their longitudinal extent, characterized in that the isosceles triangles are acute-angled and in that the covering elements have a length which is two to twenty times the width of the floor marking.

2. The floor marking as claimed in claim 1, characterized in that the distance between them is smaller than or approximately equal to their longitudinal extent.

3. The floor marking as claimed in claim 2, characterized in that all the covering elements are equidistant.

4. The floor marking as claimed in claim 2, characterized in that the covering elements converge at an acute angle at their other end.

5. The floor marking as claimed in claim 2, characterized in that the isosceles recesses and protrusions have a length which corresponds to half to a quarter of the length of the covering elements.

6. The floor marking as claimed in claim 1, characterized in that the distance between them is greater than their longitudinal extent.

7. The floor marking as claimed in claim 6, characterized in that all the covering elements are equidistant.

8. The floor marking as claimed in claim 6, characterized in that the covering elements converge at an acute angle at their other end.

9. The floor marking as claimed in claim 1, characterized in that all the covering elements are equidistant.

10. The floor marking as claimed in claim 9, characterized in that the covering elements converge at an acute angle at their other end.

11. The floor marking as claimed in claim 1, characterized in that the covering elements converge at an acute angle at their other end.

12. The floor marking as claimed in claim 11, characterized in that the acute angles at both ends have the same size.

13. The floor marking as claimed in claim 12, characterized in that the arrangement is chosen in such a way that the covering elements have the same shape, at least within groups, as the uncovered regions of the floor marking.

14. The floor marking as claimed in claim 1, characterized in that the isosceles recesses and protrusions have a length which corresponds to half to a quarter of the length of the covering elements.

15. The floor marking as claimed in claim 1, characterized in that it is covered by a non-slip and abrasion-resistant layer or film.

16. The floor marking as claimed in claim 15, characterized in that the layer or film is colored.

17. The floor marking as claimed in claim 1, characterized in that a reflective layer is arranged under the luminous layer.

18. The floor marking as claimed in claim 1, characterized in that it is designed to be self-adhesive on its underside.

19. The floor marking as claimed claim 1 in, characterized in that it is provided with a double-sided adhesive tape on its underside.

20. The floor marking of claim 1 wherein the covering elements are adjacent to one another, at least in groups in such a way that the distance between them is smaller than approximately twice their longitudinal extent.

* * * * *